US006461127B1

(12) United States Patent
Kim

(10) Patent No.: US 6,461,127 B1
(45) Date of Patent: Oct. 8, 2002

(54) FIXED DISPLACEMENT SUCTION AND EXHAUST APPARATUS UTILIZING ROTARY PISTONS OF COAXIAL STRUCTURE

(76) Inventor: Eun Kyue Kim, 108-203 Doosan Apt., 50-4-1, Jungwang-Dong (KR)

( * ) Notice: Subject to any disclaimer, the term of this patent is extended or adjusted under 35 U.S.C. 154(b) by 0 days.

(21) Appl. No.: 09/674,566

(22) PCT Filed: Mar. 30, 1999

(86) PCT No.: PCT/KR99/00152

§ 371 (c)(1),
(2), (4) Date: Oct. 27, 2000

(87) PCT Pub. No.: WO99/56021

PCT Pub. Date: Apr. 11, 1999

(30) Foreign Application Priority Data

Apr. 27, 1998 (KR) ..... 1998-014883

(51) Int. Cl.[7] ..... F01C 1/07; F01C 1/077
(52) U.S. Cl. ..... 418/36; 418/37
(58) Field of Search ..... 418/36, 37

(56) References Cited

U.S. PATENT DOCUMENTS 1,497,481 A * 6/1924 Bullington ..... 418/37
2,612,878 A * 10/1952 Wilson ..... 418/37
4,072,447 A * 2/1978 Gaspar ..... 418/36

FOREIGN PATENT DOCUMENTS

JP 52-35307 9/1975
JP 6-323103 11/1994

* cited by examiner

*Primary Examiner*—John J. Vrablik
(74) *Attorney, Agent, or Firm*—Perkins Coie LLP

(57) ABSTRACT

There is provided a fixed displacement suction and exhaust apparatus using coaxial rotary pistons, which can be used for various kinds of compressors, vacuum pumps, fluid transfer pumps or internal combustion engines. In the suction and exhaust apparatus, two rotary pistons 16*a* and 16*b* having a plurality of wing plates 17, 57, 18 and 58 radially provided in a housing 2 having a cylinder and two sealing plates, are engaged with each other to be rotated. The rotary pistons are rotatably coupled to two connecting rod elements 41*a* and 41*b* of a connecting rod 40 coupled to rotate the crank pin 15*a* of a crankshaft installed coaxially therewith. The suction and exhaust chambers are produced between the spaces of each of the wing plates of the respective rotary pistons as the rotary pistons rotates at different speeds, according to the teeth proportion of external gears 42*a* and 42*b* formed in the connecting rod 40 to internal gears 22*a* and 22*b* mounted on the housing.

7 Claims, 9 Drawing Sheets

FIXED DISPLACEMENT SUCTION AND EXHAUST APPARATUS UTILIZING ROTARY PISTONS OF COAXIAL STRUCTURE

TECHNICAL FIELD

The present invention relates to a fixed displacement suction and exhaust apparatus using coaxial rotary pistons, which can be used for various kinds of compressors, vacuum pumps, fluid transfer pumps or internal combustion engines, and more particularly, to a fixed displacement suction and exhaust apparatus using coaxial rotary pistons, wherein a crank pin of a crankshaft is installed to rotate two rotary pistons at different speeds.

BACKGROUND ART

A suction and exhaust apparatus using coaxial rotary pistons refers to a suction and exhaust apparatus having a mechanism in which suction and exhaust functions are performed by a change in the displacement between two rotary pistons by rotating the two rotary pistons at different speeds such that a plurality of suction and exhaust chambers are formed by the two rotary pistons in an annular cylinder to then be rotated along a coaxial line.

Reciprocating piston suction and exhaust apparatuses based on linear motion, which are currently in widespread use, are constructed to alternately actuate suction and exhaust functions by a set of a cylinder and a piston. Thus, whenever suction and exhaust functions are alternately performed, valves must be actuated. Also, when the displacement is increased, many cylinders and pistons are required. Further, since the cylinder of the side connected to a connecting rod is opened, the displacement efficiency is generally below 50%. To solve the above problems, there have been developed fixed displacement suction and exhaust apparatuses wherein two rotary pistons are rotated in an annular cylinder to form suction and exhaust chambers between the pistons.

Japanese Patent Publication No. Hei 5-7524 describes a planetary gear device having a sun gear, a planetary gear and an internal gear engaged in a non-circular gear combination, and a rotary piston suction and exhaust apparatus constructed to make a plurality of rotary pistons revolve at unfixed speeds inside a cylinder in synchronization with unfixed-speed revolution applied to a plurality of planetary shafts by the planetary gear device. In this suction and exhaust apparatus, since a plurality of gears are engaged in a non-circular gear combination to then be rotated, problems may be encountered with precise fabrication of gears and load resistance.

Japanese Patent Laid-open publication No. Hei 8-296401 describes an engine apparatus based on relative motion constructed to rotate a rotary piston at unfixed speeds by connecting the rotary piston to the output shaft provided in the center of a cylinder using a crankshaft. This apparatus rotates the rotary piston by complex inversion driving, in which the rotation force of the output shaft serves as a crankshaft, so that pressure is applied to the crankshaft, thereby disabling to embody the apparatus.

Japanese Patent Publication No. Hei 6-96964 describes a rotary piston engine for performing suction and exhaust functions, wherein an engine shaft coupled to an eccentric shaft acceptor, is connected to a flat shaft, and an external gear provided on the flat shaft and an internal gears provided on a cavity are combined in a ratio of 2:1 by being combined with a cylinder rotating together with the engine shaft, to thus rotate two pistons opposed to each other by a lever fixed to the eccentric shaft. According to this apparatus, since the output shaft and the flat shaft are connected to the eccentric shaft, the connecting portion thereof is liable to damages under high power.

SUMMARY OF THE INVENTION

It is an object of the present invention to provide a complex-cycle suction and exhaust apparatus that is easily fabricated due to a simplified structure and has a plurality of suction and exhaust chambers.

The object of the present invention is achieved by a suction and exhaust apparatus according to the present invention, wherein two rotary pistons having a plurality of wing plates for partitioning a cylinder into a plurality of suction and exhaust chambers, are engaged with each other so as to be installed coaxially with cylinder axis lines, the two coaxial rotary pistons are connected to a crank pin of a crankshaft to then be rotated at different speeds, and the spaces between each of the respective wing plates of the two rotary pistons are hermetically sealed to make independent suction and exhaust chambers, thereby performing suction and exhaust functions.

According to the present invention, there is provided a suction and exhaust apparatus including a cylindrical, hermetically sealed housing having supporting holes for supporting a main axis of a crankshaft, formed at both ends, and having an internal gear (or external gear) formed therein, the internal gear having the supporting holes as concentric circles thereof; a piston block having a plurality of wing plates for forming a plurality of independent hermetically sealed chambers formed inside the housing by radially protruding the outer circumference of an annular disk coaxially rotatably installed in the housing to then be hermetically sealed with the inner circumference of the housing, the piston block configured such that two rotary pistons having a connection hook on the inner circumference are engaged with each other while the wing plates cross each other; and a rotation device having a crankshaft installed coaxially with the housing so that the crank pin of the crankshaft is disposed within the annular space in the center of the rotary piston, a connecting rod rotatably connected to the crank pin of the crankshaft, external gears (or internal gears) having a teeth proportion for engagement with internal gears provided on the housing, at both ends of the shaft acceptor of the connecting rod, and two connecting rod elements for independently rotating two rotary pistons by connecting the same with a connecting hook facing the two the rotary pistons, formed at either side of the center of the shaft acceptor of the connecting rod.

The housing of the present invention consists of a cylinder and sealing plates for hermetically sealing both ends of the cylinder, and the sealing plates have a bearing for supporting the crankshaft to be rotated, mounted in a crankshaft hole installed coaxially with the cylinder. The internal gear engaged with the external gear rotating round the crank pin of the crankshaft are installed coaxially with the crankshaft. A suction hole, an exhaust hole and an ignition plug may be further formed in the cylinder according to use of the suction and exhaust apparatus. The internal gear may be mounted by fixing a gear ring, and bearings for supporting rotation of each of two rotary pistons installed inside may also be further installed on the inner surfaces of the two sealing plates.

The piston block includes two rotary pistons having the same shape and rotatably coupled with respect to the contact surface thereof to then independently be rotated, each rotary piston having an annular disk the outer diameter of which is smaller than the inner diameter of the cylinder, a plurality of wing plates radially protruding from the outer circumference of the disk, and a connection hook formed on the inner circumference of the disk. The contact surface of the two rotary pistons is leveled with the cylinder such that it is possible for the two rotary pistons to be rotated relatively in a state in which the two rotary pistons are hermetically sealed, and the outer surfaces thereof are supported by a bearing mounted on the housing to then be rotated, independently. In the radial wing plates of the rotary pistons, the axial widths thereof are the same as those of the rotary pistons. Thus, one plane of each wing plate is positioned on the same plane with one plane of the integrally formed rotary piston, and the opposite plane thereof is positioned on the same plane with the opposite outer plane of the piston coupled thereto, so that both planes of the wing plate of the rotary piston are hermetically sealed to the inner surface of the sealing plates. Also, the outer-end surface of the wing plates rotates within the cylinder in a state in which it is hermetically sealed to the inner surface of the cylinder. Reinforcement feet are preferably formed in the front and rear of the fixing parts of the wing plates for the purpose of enhancing the fixing strength when the reinforcement feet cross each other, irrespective of a displacement efficiency. According to the aforementioned configuration, the hermetically sealed spaces for forming a plurality suction and exhaust chambers partitioned by both sides of each of the wing plates of the two rotary pistons and by both sides of the housing, are produced between the outer circumference of the annular disk of each of the rotary pistons and the inner circumference of the cylinder by rotation of the rotary pistons. Floating pin holes for accommodating floating pins for actuating the rotary pistons are formed in the connection hook installed on the inner circumference of the annular disk.

The rotation device of the present invention includes the crankshaft rotatably installed in the center of the housing such that a crank pin of the crankshaft rotates around the central annular space of the rotary piston block, and the connecting rod rotatably coupled with the crank pin of the crankshaft. The connecting rod includes at least one external gear formed coaxially with the pin, at both ends of the shaft acceptor in the center, and two connecting rod elements which rotate the rotary pistons coupled therewith according to rotation of the connecting rod, are radially formed linearly at both sides of the shaft acceptor.

The number of teeth of the external gear of the connecting rod is different from that of the internal gear of the housing such that the internal gear is disposed eccentrically with respect to the external gear. Thus, if the external gear operating with rotation of the crankshaft rotates, the rotation angle of the connecting rod with respect to the center line of two rotary pistons coaxially rotating around the internal gear is changed. Therefore, the two rotary pistons coupled to the respective connecting rod elements rotate at different speeds.

The external gear of the connecting rod coupled to rotate the crank pin of the crankshaft according to the present invention, is engaged with the inner gear mounted on the housing, to rotate the crank pin while rotating with the crankshaft. The rotation angle of two points at which the diameter extending line of the external gear meets on an imaginary circumference formed by the axis core of the crankshaft as a center, periodically changes according to the rotation of the crankshaft. Due to the change in the rotation angle, the angle of wing plates of two rotary pistons which are connected to two linear connecting rod elements and rotate, also changes. Thus, the action in which the space between the wing plates of the two rotary pistons is widened or narrowed, is repeated, thereby performing suction and exhaust functions.

The rotation cycle of each rotary piston depends on the combination of the internal gear fixed on the housing and the external gear and the teeth proportion of the engaged gears. If the number of wing plates for one rotary piston is N, the teeth number of the gear fixed on the housing is N and the gear is the internal gear, then the teeth proportion of the internal gear to the external gear is N:N-1. If the fixed gear is external gear, the teeth proportion of the external gear to the internal gear is N:N+1. For example, in the case of a 8 cycle engine in which the number of wing plates of two rotary pistons is eight, the number of wing plates of each rotary piston is four. Thus, if the gear fixed on the housing is the internal gear, the teeth proportion of the internal gear to the external gear is preferably 4:4-1, that is, 4:3. Also, if the gear fixed on the housing is the external gear, the teeth proportion of the external gear to the internal gear is preferably 4:4+1, that is, 4:5.

In the case of a 6-cycle engine in which the number of wing plates of two rotary pistons is six, if the gear fixed on the housing is the internal gear, the teeth proportion of the internal gear to the external gear is preferably 3:2. Also, if the gear fixed on the housing is the external gear, the teeth proportion of the external gear to the internal gear is preferably 3:4.

In the present invention, the rotation device includes circumferential floating pins rotatably inserted into the connection hook installed within each annular disk of the rotary pistons, so that rotation of rotary pistons and connection with the connecting rod elements can be effectively achieved. Each of the floating pins includes a connection hole into which the connecting rod element of the connecting rod is inserted to move back and forth, at the central portion thereof. Also, the floating pin functions to rotate the main body of each rotary piston by inserting the rotary piston thereinto.

The floating pins are constructed such that they pivotally move within a fan-shaped space of the respective rotary piston so as not to obstruct mutual rotation of the rotary pistons when they are linearly connected by the respective connecting rod elements to then rotate at different speeds. The angles between two rotary pistons and the connecting rod are changed hen the connecting rod rotates eccentrically with respect to the rotary pistons. Thus, the floating pins rotate as the connecting rod elements move back and forth. Also, the floating pins serve to facilitate the rotation of two rotary pistons irrespective of a change in the rotation angle.

According to the aforementioned construction, the connecting rod coupled to the crank pin of the crankshaft rotates all the time on the concentric circle of the axis core of the rotary piston, from the eccentric location with respect to the axis core of the internal gear formed on the housing. Since the teeth number of the external gear of the connecting rod is different from that of the internal gear of the housing, engaged therewith, the respective rotary pistons connected to the two connecting rod elements of the connecting rod, rotate at different speeds depending on a predetermined proportion of teeth numbers, according to the rotation of the crankshaft.

As the two rotary pistons rotate at different speeds, the rotation speeds of the wing plates formed thereon also differ, so that the space between the wing plates of the two rotary pistons repeatedly gets widened or narrowed, thereby performing suction and exhaust functions. In the suction and exhaust apparatus according to the present invention, the number of suction and exhaust chambers can be changed by varying the number of wing plates of each rotary piston, according to use and capacity. For example, in the case of constructing a 4-cycle internal combustion engine, in consideration of uniformity in the load, in order to perform only suction and exhaust functions in which 8 cycles with 4 cycles combined are appropriate, it is more suitably used to repeat 6 cycles 3 times.

BEST MODE FOR CARRYING OUT THE INVENTION

Figure 1:
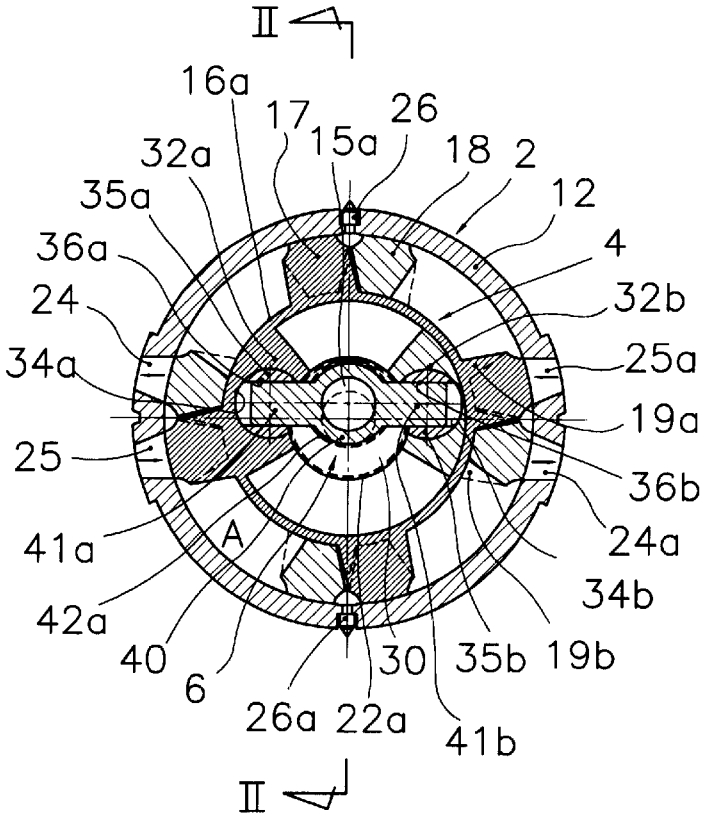
FIG. 1 is a lateral sectional view schematically illustrating a suction and exhaust apparatus according to an embodiment of the present invention applied to an 8 cylinder internal combustion engine, taken along a line I—I of FIG. 2.

An embodiment of the present invention applied to a 8 cylinder internal combustion engine is shown as the lateral sectional view of FIG. 1.

Figure 2:
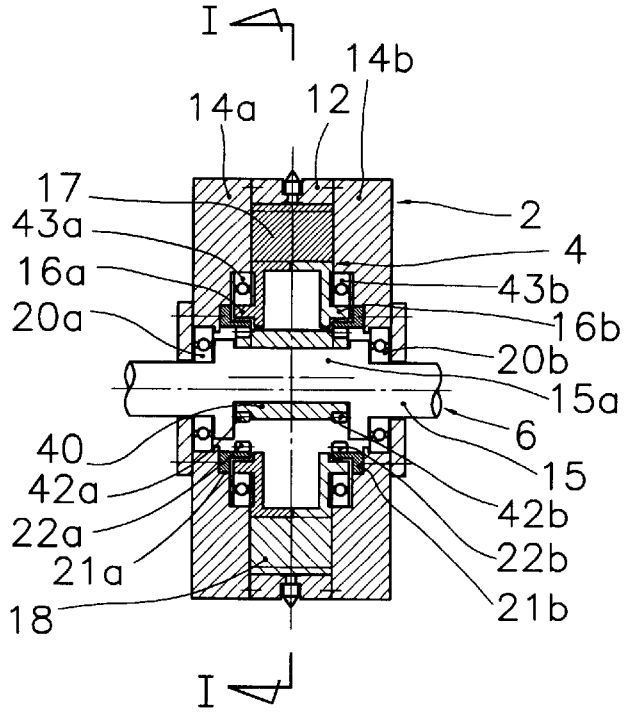
FIG. 2 is a longitudinal sectional view taken along a line II—II of FIG. 1.
Figure 3:
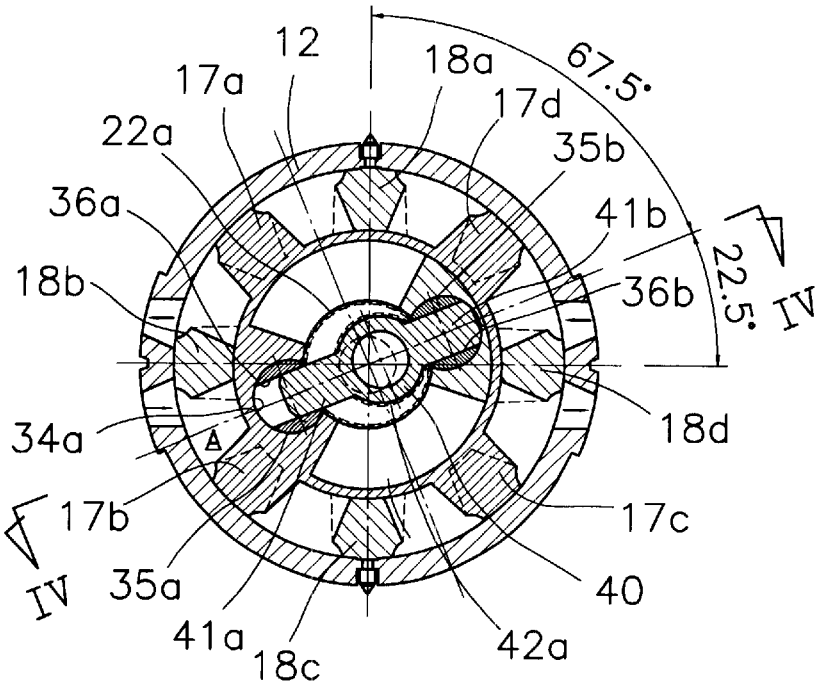
FIG. 3 is a lateral sectional view illustrating the case in which a crankshaft of the apparatus shown in FIG. 1 is rotated by 67.5 degrees, taken along a ling III—III of FIG. 3.
Figure 4:
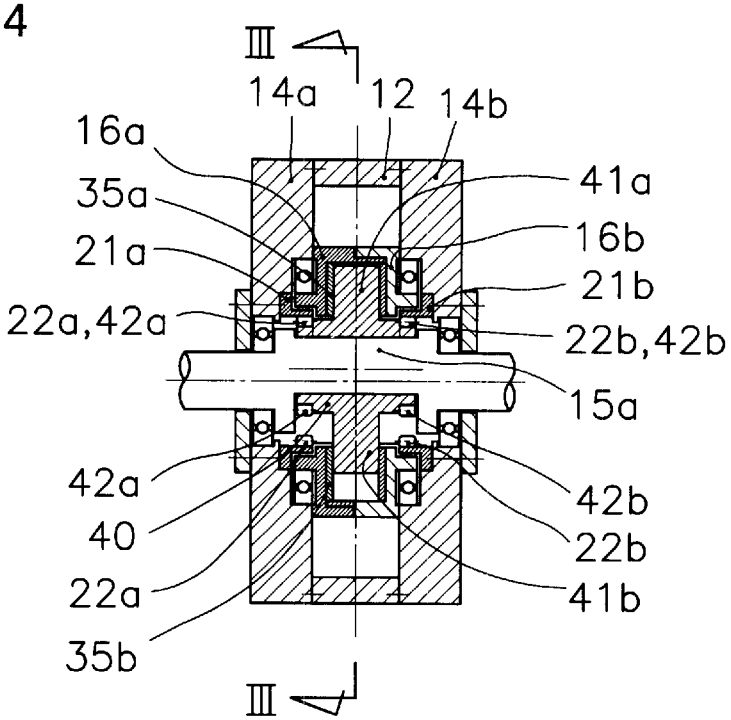
FIG. 4 is an axial sectional view, taken along a ling IV—IV of FIG. 3.
Figure 5:
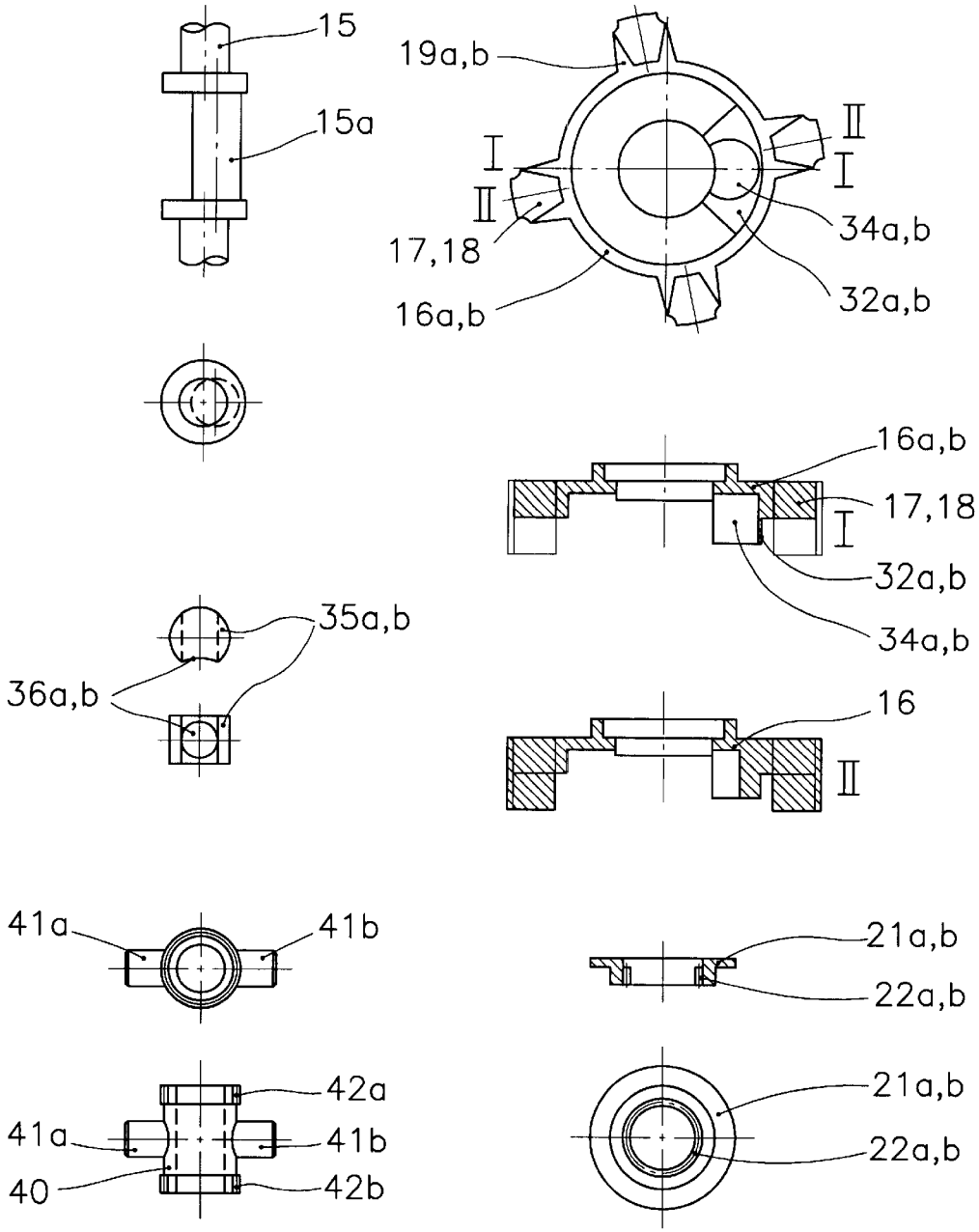
FIG. 5 is a diagram illustrating essential components shown in FIG. 1.
Figure 6:
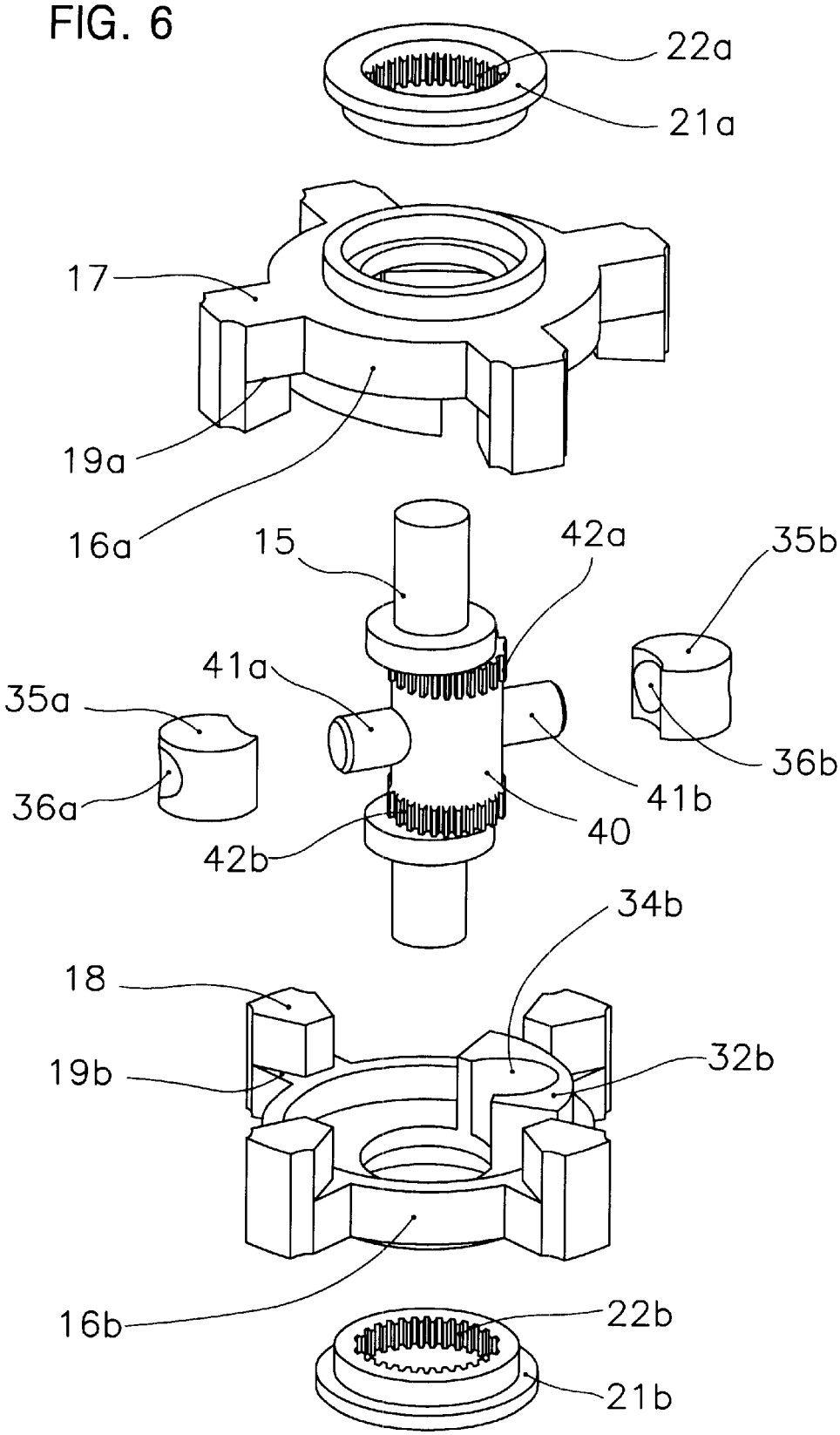
FIG. 6 is a perspective view illustrating internal components, with an outer housing of the engine shown in FIG. 1 removed.

FIG. 1 is a longitudinal sectional view of a suction and exhaust apparatus according to the present invention applied to an 8 cylinder internal combustion engine, taken along a line I—I of FIG. 2, and FIG. 2 is an axial sectional view taken along a line II—II of FIG. 1.

FIGS. 1 and 2 schematically show essential points in the operation of the suction and exhaust apparatus according to the present invention, and assembly means and general-purpose components will not be described.

Referring to FIGS. 1 and 2, the suction and exhaust apparatus according to the present invention includes a housing 2 having a cylinder 12 and sealing plates 14*a* and 14*b* covering both ends of the cylinder 12 to form a chamber for a suction and an exhaust; a piston block 4 having two rotary pistons 16*a* and 16*b* installed in the cylinder 12 and partitioning the chamber into a plurality of unit suction and exhaust chambers to function as a suction and exhaust device; and an actuator device 6 having a crankshaft 15 for rotating the piston block 4.

The crankshaft 15 is rotatably supported at both ends on bearings 20*a* and 20*b* fit in an axial hole through the sealing plates 14*a* and 14*b*. Gear rings 21*a* and 21*b* having internal gears 22*a* and 22*b* are fixed to the two sealing plates 14*a* and 14*b* by means of bolts or the like.

The cylinder 12 has an exhaust hole 24 and a suction hole 25 at a side wall, and also has an exhaust hole 24*a* and a suction hole 25*a* at opposite side wall. Also, the cylinder 12 has ignition plugs 26 and 26*a* at a side wall disposed at a right angle with respect to the centers of two suction holes and two exhaust holes.

Two rotary pistons 16*a* and 16*b* consisting of the piston block 4, which are engaged with each other to be incorporated into one body, are installed inside the cylinder 12 to be capable of independently rotating. Each of the rotary pistons 16*a* and 16*b* has a plurality of wing plates 17 and 18 which are radially formed. In the apparatus shown in FIG. 1, for use in an 8 cylinder internal combustion engine, the wing plates 17 and 18 consist of each four wing plates 17*a*–17*d* and 18*a*–18*d*, respectively.

The wing plates 17 and 18 have both ends of an axial direction hermetically sealed to the inner surfaces of two sealing plates 14*a* and 14*b*, and the surface of outer circumference thereof hermetically sealed to the inner circumference of the cylinder 12, thereby forming an independent unit suction and exhaust chamber maintained at a hermetically sealed state when the rotary pistons 16*a* and 16*b* rotate, between the respective wing plates. Thus, in the suction and exhaust apparatus shown in FIG. 1, in which the two rotary pistons 16*a* and 16*b* have 8 wing plates, 8 suction and exhaust chambers independently partitioned by 8 wing plates are provided. The wing plates 17*a*–17*d* and 18*a*–18*d* have reinforcement feet formed in the front and rear surfaces of the wing plates fixed to the outer circumference of an annular disk. The reinforcement feet cross each other when the wing plates get most close to each other, thereby increasing the fixed surfaces of the wing plates and enhancing the strength to facilitate multiple-cylinder construction of the apparatus, while preventing a decrease in the displacement efficiency.

The rotary pistons 16*a* and 16*b* have the same structure, and has a circular space 30 formed in the center of the annular disk. Floating pin holes 34*a* and 34*b* are formed in the connecting hooks 32*a* and 32*b* positioned in the inner circumference of the space. Floating pins 35*a* and 35*b* are rotatably installed in the floating pin holes 34*a* and 34*b* installed in the rotary pistons 16*a* and 16*b*. The floating pins 35*a* and 35*b* have radial connecting holes 36*a* and 36*b* which insert the connecting rod elements 41*a* and 41*b* of the connecting rod 40 thereinto to be connected to be described later. The rotary pistons 16*a* and 16*b* are hermetically sealed so that mutual inner contact surfaces thereof rotate. Also, the outer surfaces are hermetically sealed to the inner surfaces of the two sealing plates 14*a* and 14*b*. Thus, the rotary pistons 16*a* and 16*b* are supported by the bearings 43*a* and 43*b* fixed to the inner surfaces of the sealing plates 14*a* and 14*b* to then be rotated.

The two rotary pistons form a set of piston block 4 coupled to hermetically seal the side walls of the outer circumference thereof. A crank pin 15*a* of the crankshaft 15 is disposed inside a central annular space 30 of the two rotary pistons 16*a* and 16*b*, and the connecting rod 40 is rotatably coupled to the crank pin 15*a* of the crankshaft 15. The connecting rod elements 41*a* and 41*b* facing each other are linearly formed at either side of the connecting rod 40, centered on the shaft acceptor thereof. External gears 42*a* and 42*b* engaged with the internal gears 22*a* and 22*b* of the gear rings 21*a* and 21*b* fixed to the two sealing plates 14*a* and 14*b*, are formed at both ends of the shaft acceptor of the connecting rod 40 to then rotate together with the connecting rod 40. Here, the teeth proportion of the internal gears to the external gears becomes 4:3. The connecting rod elements 41*a* and 41*b* formed in the connecting rod 40 are coupled to the connecting holes 36*a* and 36*b* of the floating pins 35*a* and 35*b* inserted in the floating pin holes 34*a* and 34*b* of the rotary pistons 16*a* and 16*b* so as to be movable back and forth. According to the aforementioned construction, when the crankshaft 15 rotates, the connecting rod 40 coupled to the crank pin 15*a* also rotates round the crank pin 15*a* as a rotation axis. Since the external gears 42*a* and 42*b* of the connecting rod 40 are engaged with the internal gears 22*a* and 22*b* fixed to the housing, the connecting rod 40 rotates in the opposite direction of the rotation direction of the crankshaft 15. Accordingly, the connecting rod elements 41*a* and 41*b* of the connecting rod pull the corresponding rotary pistons 16*a* and 16*b* coupled through the floating pins 35*a* and 35*b* to then rotate the same. Here, the rotary pistons rotate at different speeds as the rotation angle of the crankshaft becomes different from the rotation angle of the connecting rod according to the teeth proportion of the internal gears to the external gears. The space between each of the wing plates 17*a*–17*d* and 18*a*–18*d* of the respective rotary pistons get widened or narrowed while rotating round the cylinder, thereby performing suction and exhaust functions.

The operation of the suction and exhaust apparatus according to the present invention will now be described.

Figure 8:
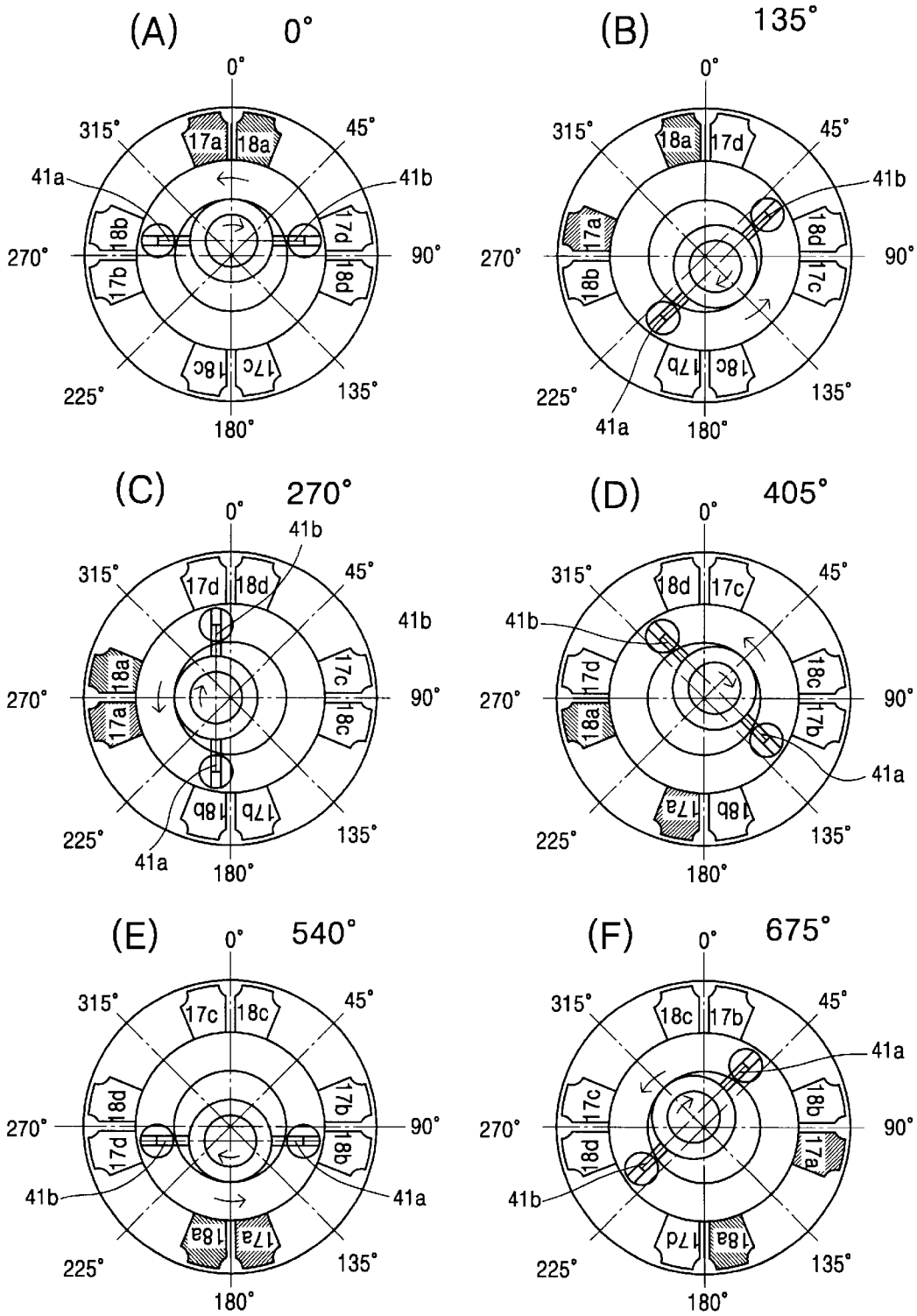
FIG. 8 is a diagram illustrating the operation state of two rotary pistons according to rotation of a crankshaft, in which the teeth proportion of the external gear to internal gear is 4:3.

In the apparatus according to the present invention, the crankshaft 15 is rotated using a power supply (not shown). Referring to FIG. 8, when the crankshaft 15 rotates, while the crank pin 15*a* eccentrically moves by 135 degrees based on the origin (0 degrees on the axis) from a location A to a location B, shown in FIG. 8, the connecting rod 40 coupled to the crank pin 15*a* rotates round the crank pin 15*a* as a rotation axis by 45 degrees in the opposite direction of the rotation direction of the crankshaft by engagement between the external gears 42*a* and 42*b* and the fixed internal gears 22*a* and 22*b*. Accordingly, while the floating pin 35*a* coupled to the connecting rod element 41*a* of the connecting rod 40 and the floating pin 35*b* coupled to the connecting rod element 41*b* move from the location A of FIG. 8 to the location B, they move the rotary pistons connected thereto by the movement distance of each floating pin, thereby allowing the two rotary pistons 16*a* and 16*b* to rotate at different speeds.

As the two rotary pistons move at different speeds, during rotation of the wing plates 17*a*–17*d* of the rotary piston 16*b* rotating by 22.5 degrees together with the floating pin 35*a*, the wing plates 18*a*–18*d* of the rotary piston 16*a* rotate by 67.5 degrees. Thus, the spaces between each of the wing plates 17*a* and 18*b*, the wing plates 17*b* and 18*c*, the wing plates 17*c* and 18*d*, and the wing plates 17*d* and 18*a*, get widened, thereby performing a suction function. Simultaneously, the spaces between each of the wing plates 17*a* and 18*a*, the wing plates 17*b* and 18*b*, the wing plates 17*c* and 18*c*, and the wing plates 17*d* and 18*d*, get narrowed, thereby performing an exhaust function. Therefore, the suction and exhaust apparatus according to the present invention is constructed for use in an internal combustion engine, as shown in FIG. 1, in which a suction function is performed at four chambers and simultaneously an exhaust function is performed at the other four chambers while the crankshaft rotates by 135 degrees.

Figure 9:
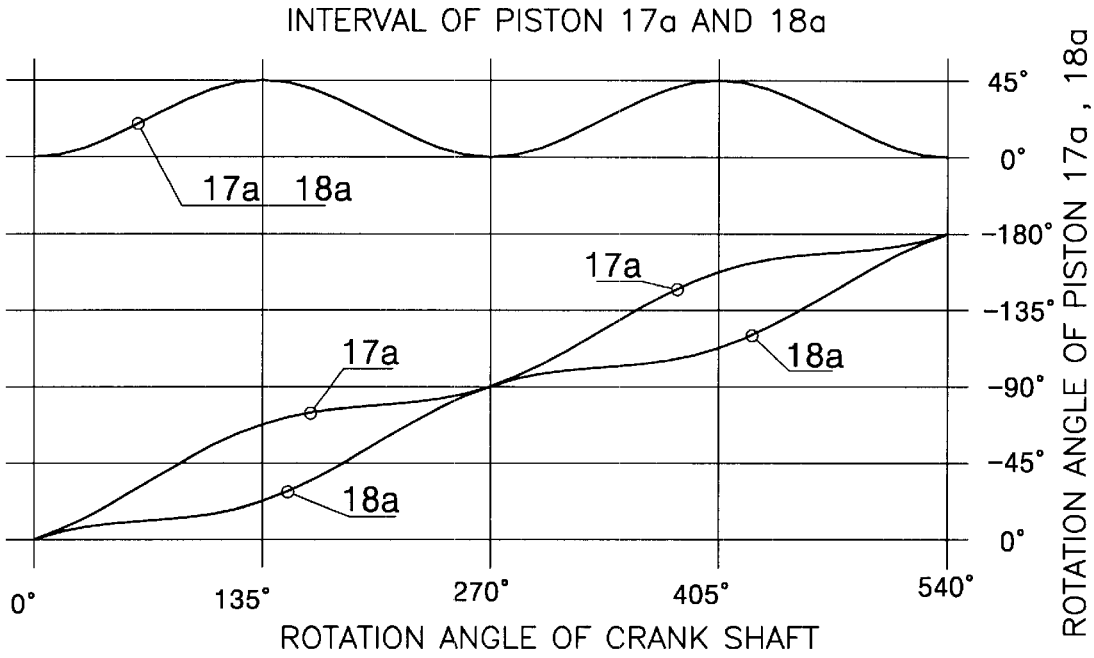
FIG. 9 is a graph showing a change in the rotation angle of two rotary pistons and the displacement of suction and exhaust chambers, depending on the rotation angle of a crankshaft in the apparatus shown in FIG. 8.

FIG. 8 is a diagram illustrating the different-speed cycle actuation of two rotary pistons 16*a* and 16*b* according to rotation of the crankshaft 15, by location of and intervals between the wing plates 17*a*–17*d* and 18*a*–18*d*, in the case when the teeth proportion of the internal gears 22*a* and 22*b* to the external gears 42*a* and 42*b* is set to 4:3. As shown in FIG. 8, when the crankshaft 15 rotates by 135 degrees, the connecting rod elements 41*a* and 41*b* of the connecting rod 40 coupled to the crank pin 15*a* rotate by 45 degrees in the opposite direction. Thus, in FIG. 8, when the crankshaft rotates by 135 degrees to the right-hand side, the connecting rod elements 41*a* and 41*b* rotate by 45 degrees to the left-hand side, so that the sum of the left and right rotation angles becomes 180 degrees, thereby allowing the crank pin and the connecting rod elements to be disposed at right angles. The connecting rod positioned at the highest point as in the location A of FIG. 8 moves to the lowest point as in the location B, so that the space between the wing plates 17*a* and 18*a* gets widened from the angle of 0 degrees to the angle of 45 degrees, which will be represented by the graph shown in FIG. 9. When the crankshaft rotates by 135 degrees, the wing plate 17*a* rotates 67.5 degrees and the wing plate 18*a* rotates 22.5 degrees, so that the space between the wing plates gets widened by 45 degrees. As described above, if the crankshaft 15 consecutively rotates by each 135 degrees 8 times so that 360 degree rotation is repeatedly performed 3 times, the connecting rod elements 41*a* and 41*b* rotate repeatedly 8 times by each 45 degrees, that is, 360 degree rotation is performed once, to then be restored to the origin. The stroke and arrangement angle of the crankshaft, the number of wing plates of each rotation piston, the combination and teeth proportion of internal and external gears, or the like, are related to one another, and can be changed according to use and purpose of the suction and exhaust apparatus.

Figure 7:
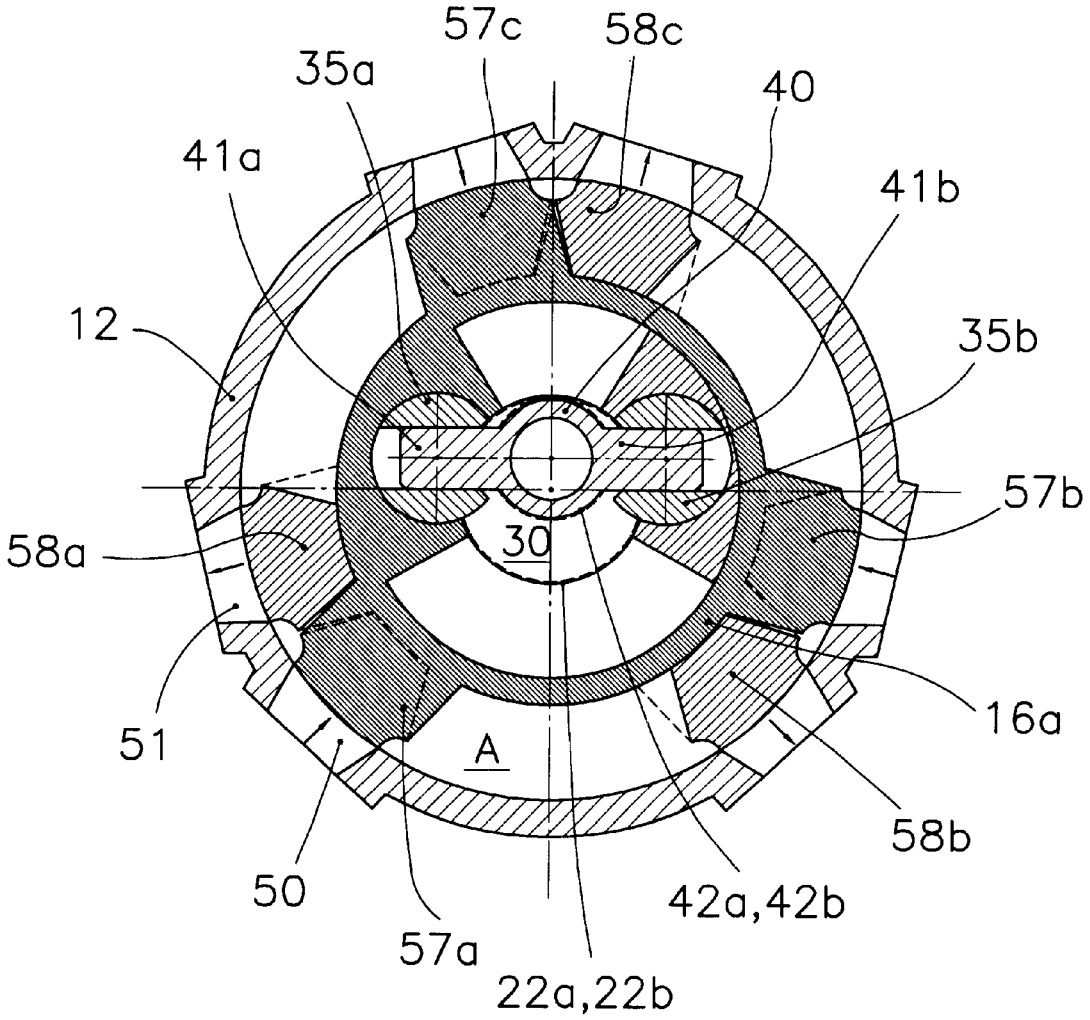
FIG. 7 is a lateral sectional view illustrating an example of the suction and exhaust apparatus according to the present invention shown in FIG. 1, applied to a fluid suction and exhaust apparatus, in which the teeth proportion of the internal gear to external gear is 3:2.

FIG. 7 illustrates another embodiment of the suction and exhaust apparatus according to the present invention, which is advantageously used for fluid compression or transfer. In FIG. 7, the same functional elements as those in FIG. 1 are denoted by the same reference numerals. The suction and exhaust apparatus shown in FIG. 7 includes a piston block 4 coupled to the crankshaft, like the apparatus shown in FIG. 1. In this apparatus, the cylinder 12 has three suction holes 50 and three exhaust holes 51, disposed in a triangular configuration, respectively. The two rotary pistons 16*a* and 16*b* forming the piston block 4 have wing plates 57 and 58 each consisting of three wing plates 57*a*–57*c* and three wing plates 58*a*–58*c*, respectively. The internal gears 22*a* and 22*b* and the external gears 42*a* and 42*b* of the suction and exhaust apparatus shown in FIG. 7 are constructed such that the teeth proportion thereof becomes 3:2. Therefore, in this apparatus, six suction and exhaust chambers A are produced as the rotary pistons 16*a* and 16*b* rotate.

Figure 10:
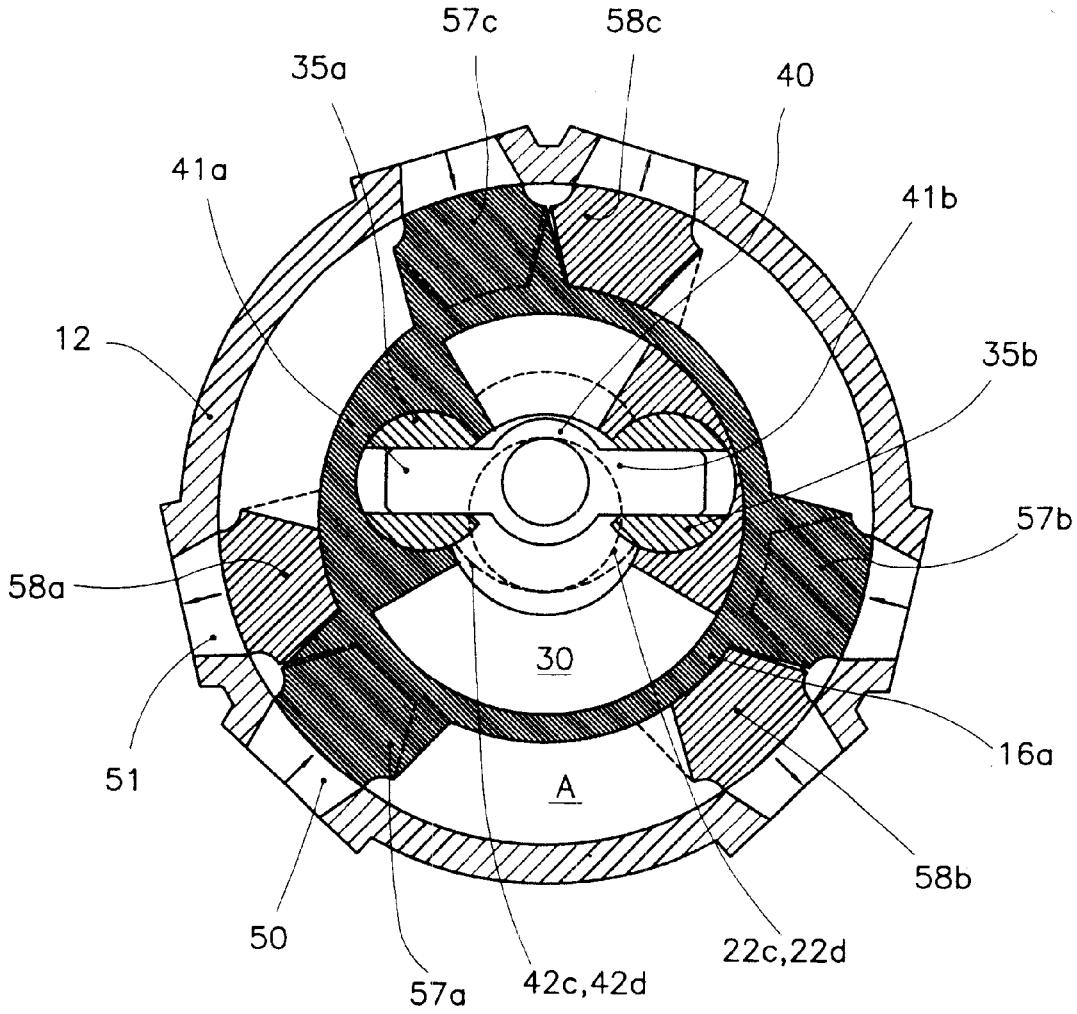
FIG. 10 is a lateral sectional view schematically illustrating a suction and exhaust apparatus according to another embodiment of the present invention.
Figure 11:
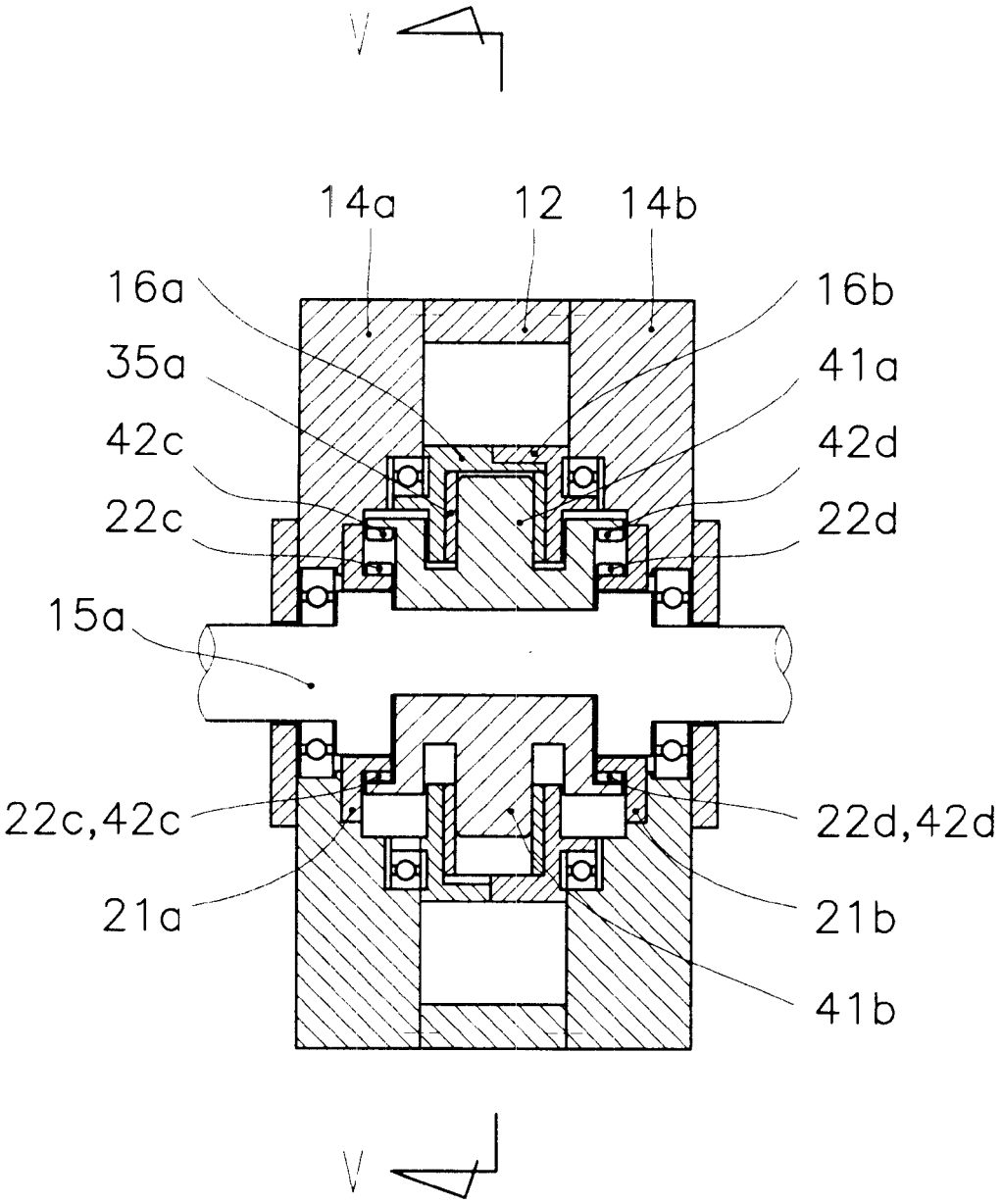
FIG. 11 is a longitudinal sectional view axially taken along a line V—V of FIG. 10.

FIGS. 10 and 11 show another embodiment of the present invention. In the embodiment, the ring gear 21*a*, 21*b* coaxially fixed in the axial bore of each sealing plate 14*a*, 14*b* has an external gear 22*c*, 22*d* on the outer periphery thereof and the connecting rod 40 sleeved on the crank pin 15*a* has an internal gear 42*c*, 42*d* in mesh with the external gear 22*c*, 22*d*. In the case that the number of wing plate 17, 18 on each rotary piston 16*a*, 16*b* is N, the ratio of the number of the teeth of the external gear 22*c*, 22*d* to the internal gear 42*c*, 42*d* is N:N+1.

EFFECT OF THE INVENTION

According to the present invention, the internal gears 22*a* and 22*b* mounted on the housing are engaged with the external gears 42*a* and 42*b* of the connecting rod 40 rotatably coupled with the crank pin 15*a* of the crankshaft 15 formed coaxially therewith, two connecting rod elements 41*a* and 41*b* formed in the connecting rod 40 are coupled to the rotary pistons 16*a* and 16*b*, respectively to rotate the two rotary pistons 16*a* and 16*b* at different speeds, and then the spaces between each of wing plates of the respective rotary pistons get widened or narrowed. Since the suction and exhaust functions are performed by the above-described procedure so that 8 suction and exhaust chambers are actuated in repeated cycles, the displacement efficiency can be increased and uniform load can be distributed to reduce the load of various parts. Therefore, a light-weight apparatus can be attained and the number of components thereof can be reduced, thereby simplifying the structure. In particular, major components are formed by rotary processing, thereby further enhancing the precision. Also, an apparatus that is durable against long time motion can be provided at low cost.

What is claimed is:

1. A fluid suction and exhaust apparatus using coaxial rotary pistons, comprising:

a housing 2 including:

a cylinder 12 having a plurality of exhaust holes 24 and 24*a* and a plurality of suction holes 25 and 25*a* disposed oppositely to each other on the sidewall thereof;

sealing plates 14*a* and 14*b* covering both ends of the cylinder 12, respectively, to form a chamber in the cylinder 12; and ring gears 21*a* and 21*b* fitted in an axial bore of each sealing plate 14*a*, 14*b*, each ring gear 21*a*, 21*b* having an internal gear 22*a*, 22*b* on the inner sidewall thereof;

a piston block 4 including:

a couple of rotary pistons 16*a* and 16*b* coupled coaxially with each other, each rotary piston 16*a*, 16*b* formed generally in an annular disk with an axial bore to be rotatably received in the cylinder 12 and having an annular space 30; and a plurality of wing plates 17 and 18 protruded radially outwardly on the outer sidewall thereof to be slidably contact with the inner sidewall of the cylinder 12 and partition the chamber of the cylinder 12 into a plurality of suction chambers and exhaust chambers A;

an actuator device 6 including:

a crankshaft 15 axially passing through the cylinder 12 and rotatably supported at both ends on the axial bore of the sealing plates 14*a*, 14*b;* a crank pin 15*a* formed eccentrically to the axis of the crankshaft 15 to be located in the annular space 30 of the rotary pistons; and a connecting rod 40 sleeved on the crank pin 15*a* to connect said two rotary pistons 16*a* and 16*b* to each other and having at least one external gear 42*a*, 42*b* internally meshed with the internal gear 22*a*, 22*b* of the ring gear 21*a*, 21*b*.

2. The fluid suction and exhaust apparatus according to claim 1, wherein each of the rotary pistons 16*a*, 16*b* includes a connecting hook 32*a*, 32*b* on the inner sidewall thereof, the connecting hooks 32*a*, 32*b* being opposite to each other and having a floating pin hole 34*a*, 34*b* and a floating pin 35*a*, 35*b* slidably fits in the floating pin hole 34*a*, 34*b* and having a connecting hole 36*a*, 36*b* for receiving one end of the connecting rod 40.

3. The fluid suction and exhaust apparatus according to claim 1, wherein the number of wing plates 17, 18 on each rotary piston 16*a*, 16*b* is N and the ratio of the number of the teeth of the internal gear 22*a*, 22*b* to the external gear 42*a*, 42*b* is N:N−1.

4. The fluid suction and exhaust apparatus according to claim 1, wherein each of the wing plates 17 and 18 has a reinforcing foot 19, the reinforcing foot 19 being overlapped with each other.

5. The fluid suction and exhaust apparatus according to claim 1, wherein each of the rotary pistons 16*a* and 16*b* has four wing plates 17*a*–17*d*, 18*a*–18*d* and the ratio of the number of the teeth of the internal gear 22*a*, 22*b* to the external gear 42*a*, 42*b* is 4:3 and an ignition plug is provided in the chamber A for use in an internal combustion engine.

6. A fluid suction and exhaust apparatus using coaxial rotary pistons, comprising:

a housing 2 including:

a cylinder 12 having a plurality of exhaust holes 24 and 24*a* and a plurality of suction holes 25 and 25*a* disposed oppositely to each other on the sidewall thereof;

sealing plates 14*a* and 14*b* covering both ends of the cylinder 12, respectively, to form a chamber in the cylinder 12; and ring gears 21*a* and 21*b* fitted in an axial bore of each sealing plate 14*a*, 14*b*, each ring gear 21*a*, 21*b* having an external gear 22*c*, 22*d* on the inner sidewall thereof;

a piston block 4 including:

a couple of rotary pistons 16*a* and 16*b* coupled coaxially with each other, each rotary piston 16*a*, 16*b* formed generally in an annular disk with an axial bore to be rotatably received in the cylinder 12 and having an annular space 30; and a plurality of wing plates 17 and 18 protruded radially outwardly on the outer sidewall thereof to be slidably contact with the inner sidewall of the cylinder 12 and partition the chamber of the cylinder 12 into a plurality of suction chambers and exhaust chambers A; and an actuator device 6 including:

a crankshaft 15 axially passing through the cylinder 12 and rotatably supported at both ends on the axial bore of the sealing plates 14*a*, 14*b;* a crank pin 15*a* formed eccentrically to the axis of the crankshaft 15 to be located in the annular space 30 of the rotary pistons; and a connecting rod 40 sleeved on the crank pin 15*a* to connect said two rotary pistons 16*a* and 16*b* to each other and having at least one internal gear 42*c*, 42*d* internally meshed with the external gear 22*c*, 22*d* of the ring gear 21*a*, 21*b*.

7. The fluid suction and exhaust apparatus according to claim 6, wherein the number of wing plates 17, 18 on each rotary piston 16*a*, 16*b* is N and the ratio of the number of the teeth of the external gear 22*e*, 22*f* to the internal gear 42*c*, 42*d* is N:N+1.

* * * * *